US005354145A

United States Patent [19]

Sterner

[11] Patent Number: 5,354,145

[45] Date of Patent: Oct. 11, 1994

[54] COLD-APPLIED FAST-SETTING ROAD REPAIR MATERIAL, APPLICATOR, AND METHOD

[76] Inventor: Carl L. Sterner, 3860 Nord Rd., Bakersfield, Calif. 93312-9215

[21] Appl. No.: 804,650

[22] Filed: Dec. 10, 1991

[51] Int. Cl.[5] ..... E01C 7/06; E01C 23/02; E01C 23/08

[52] U.S. Cl. ..... 404/75; 404/107; 404/92

[58] Field of Search ..... 404/17, 19, 70, 75, 404/82, 107, 92; 428/332, 256, 266, 500; 52/514, 517; 427/136, 138, 140; 524/71

[56] References Cited

U.S. PATENT DOCUMENTS

| | | | |
|---|---|---|---|
| 1,165,331 | 12/1915 | Gray . | |
| 1,397,045 | 11/1921 | Finley . | |
| 1,750,104 | 3/1930 | Heltzel . | |
| 2,420,410 | 5/1947 | Blankner | 94/39 |
| 2,578,080 | 12/1951 | Middlestadt . | |
| 2,669,915 | 2/1954 | McConnaughay . | |
| 3,260,176 | 7/1966 | Bowers | 94/39 |
| 3,398,662 | 8/1968 | Takata et al. . | |
| 3,519,169 | 7/1970 | Holland . | |
| 3,712,681 | 1/1973 | Marino et al. | 302/20 |
| 3,771,893 | 11/1973 | Miller | 404/101 |
| 3,909,474 | 9/1975 | Borchert et al. | 404/17 X |
| 3,932,051 | 1/1976 | Cleary | 404/17 X |
| 3,932,331 | 1/1976 | Doi et al. | 427/138 X |
| 4,072,435 | 2/1978 | Coho, Jr. et al. | 404/110 |
| 4,124,325 | 11/1978 | Cutler . | |
| 4,146,672 | 3/1979 | Jasperson | 52/517 X |
| 4,169,088 | 9/1979 | Hansen | 52/517 X |
| 4,256,804 | 3/1981 | Jasperson | 52/517 X |
| 4,392,335 | 7/1983 | Heiman | 404/17 X |
| 4,423,980 | 1/1984 | Warnock | 404/83 |
| 4,436,772 | 3/1984 | Yamabe et al. | 427/386 X |
| 4,453,856 | 6/1984 | Chiostri | 404/91 |
| 4,473,320 | 9/1984 | Register | 404/91 |
| 4,511,284 | 4/1985 | Sterner | 404/111 |
| 4,514,445 | 4/1985 | Hokamura et al. | 427/410 |
| 4,534,674 | 8/1985 | Cutler | 404/75 |
| 4,603,999 | 8/1986 | Laditka | 404/112 |
| 4,668,315 | 5/1987 | Brady et al. | 52/309.1 X |
| 4,695,186 | 9/1987 | King | 404/111 |
| 4,714,507 | 12/1987 | Ohgushi | 404/75 X |
| 4,820,078 | 4/1989 | Brocious | 404/92 |
| 4,828,429 | 5/1989 | Kirchner et al. | 404/111 |

FOREIGN PATENT DOCUMENTS

| | | |
|---|---|---|
| 841060 | 5/1939 | France . |
| 2530694 | 1/1984 | France . |
| 732433 | 5/1980 | U.S.S.R. . |

*Primary Examiner*—Kenneth J. Dorner
*Assistant Examiner*—Nancy Mulcare
*Attorney, Agent, or Firm*—John W. Montgomery

[57] ABSTRACT

An ambient temperature applied asphalt emulsion material is disclosed for repairing traffic-bearing surfaces. A method of applying the asphalt emulsion material for quick hardening by the addition of a hardening agent is shown. An applicator wand which applies the emulsion and hardening agent mixture to a surface and smooths the applied material for hardening level with the surface.

3 Claims, 1 Drawing Sheet

COLD-APPLIED FAST-SETTING ROAD REPAIR MATERIAL, APPLICATOR, AND METHOD

TECHNICAL FIELD OF THE INVENTION

The present invention relates to a material for filling cracks in traffic bearing surfaces, such as roadways and the like, to an applicator wand for applying the crackfiller material, and to a method of using such material for filling cracks. More particularly, the invention relates to an asphaltic crackfiller material and a device and method by which the material is applied cold and is quick-setting.

BACKGROUND OF THE INVENTION

Traffic-bearing surfaces such as roadways and walkways, whether constructed of asphalt or concrete materials are subject to wear and deterioration from vehicular traffic, from thermal expansion and contraction, rain and freezing weather conditions, and also from settling and ground-shifting such that it is common for surface cracks and potholes to develop. These cracks and holes if left unattended can result in further and more severe roadway damage. For this reason, it has become a common practice to fill the cracks and holes with a material which will restore the surface, exclude water, and otherwise repair the roadway. A smooth surface is preferably restored so that increased pressure due to bouncing wheels and the like will be avoided.

Currently, for crackfilling, high temperature asphalt and rubber mixtures are used, which when applied to the cracks at a high temperature are in a fluid state so that they flow into the crack to leave a substantially level surface. Cooling to standard atmospheric temperatures quickly hardens the hot asphalt and rubber mixture. Hot patching of potholes and hot paving of roadways is also common. Typically, the patching or paving material is mixed and heated in an aggregate to a plastic consistency. It is pressed or rolled to provide a smooth surface. The methods and materials require that the asphalt or rubber material be maintained for application at elevated and often dangerously high temperature levels. At such elevated temperatures, contact with the material before it cools, can causing burning. Also, there is a risk of ignition of the fumes.

Ductile asphalt emulsions comprising asphalt and resins and/or maltines which partially dissolve or anneal the existing asphalt roadway have also been used for road repair. The volatility and expense of applying such materials is often undesirable. Sanding or the application of an aggregate following the application of the ductile emulsion is usually required.

Alternatively, water emulsions comprising emulsified asphalt are available for mixing with aggregate. However, such materials are available in two (2) forms, both of which are inappropriate for crackfilling, and one of which is inappropriate for pothole patching and paving. First, there are cationic emulsions which set so quickly that they must have a retarder added to the mix so that it can be mixed without setting up in the mixer. Such materials with a retarder are not suitable for crackfilling because they are too thin to fill a crack and do not expand and contract without additives. Also, cationic emulsions do not always mix with the type of aggregate rock chips available in a given locality and therefore, results in additional expense for importing rock chips with appropriate characteristics for proper mixing.

Other emulsions which are available are anionic emulsions composed of water emulsified asphalt. However, the anionic emulsions are extremely slow setting and remain liquid at standard atmospheric temperatures for long periods of time. Such anionic emulsions have been useful for operations such as "fog sealing" of roadways in which an extremely light and thin coating of the emulsion is dispersed as a mist or a fog over a wide area. However, the application of anionic emulsions to cracks or potholes results in a fluid or plastic pool of the emulsion which is extremely slow to set up. Many hours or even a number of days are required for setting to take place. This disadvantageously requires the traffic area to be closed for an extended period of time and can be cost-prohibitive where the use of the roadway or traffic area is necessary for daily commerce.

SUMMARY OF THE INVENTION

These and other drawbacks and disadvantages have been overcome by the present invention in which an anionic emulsified asphalt, latex and ground rubber powder formula has been made more useful for crackfilling, pothole repairs, and roadway paving by the addition of a hardening agent or accelerator, Preferably, the hardening agent is added immediately prior to application or during application of the crackfilling material to the surface to be repaired. Solidification of the anionic emulsion is promoted within a few hours or even within minutes of the application so that the traffic surface is available for use within an economically feasible short time period after the repair is completed.

According to another feature of the invention, the hardening agent applied to the anionic emulsion is salt water which is inexpensive, readily available, and substantially non-toxic and environmentally safe.

According to another feature of the invention, the anionic cold emulsified asphalt, latex, ground rubber mix is applied through an applicator wand or spray nozzle and the hardening agent is simultaneously sprayed through one or more nozzle tips into the crackfilling area and the crackfiller material as it is being applied.

It is a further feature of the present invention to provide, at the end of crackfiller material applicator wand, a rubber smoothing blade which allows the operator to smooth a fluidic anionic emulsified material so that it is level with the roadway surface. The hardening agent is applied before, during, and after the crackfiller material is applied so that it hardens throughout at a smooth level with the existing surface.

It is another feature of the invention to provide accelerated hardening of anionic paving material emulsions by mixing the emulsion with the hardening agent or accelerator agent immediately before or concurrently with or shortly after the paving material is applied to repair or construct a roadway or traffic-bearing surface.

BRIEF DESCRIPTION OF THE DRAWINGS

These and other features of the invention will become more evident with reference to the drawings in which like reference numerals represent like elements and in which.

DESCRIPTION OF THE PREFERRED EMBODIMENTS

A formula has been discovered which is suitable for a cold-applied fast-setting crackfill material. The material comprises an anionic emulsified asphalt, emulsified latex and ground rubber powder mixture. Preferably, it is a water-emulsified asphalt and an emulsified latex to which ground or fine particulate rubber powder is mixed as a flexible filler material. The anionic emulsion may, for example, be comprised of a type of asphalt known by the designation SS1H. This material has been known primarily for use for a type of "fog" seal or light spray coating to be placed on an asphalt roadway to seal the surface. This material is normally very slow setting and unsatisfactory for the use in operations, such as crackfilling or pothole filling, where the applied thickness will prevent it from setting up or solidifying within an acceptably short time period. However, it is very useful where long-term storage is required as the setting time is very long.

Cationic asphalt emulsions with quick-setting characteristics have been used for pothole filling and paving operations. However, such materials set so quickly that they require a retarder to maintain the emulsion prior to applications and cannot be maintained in a sufficiently fluid consistency for smoothly applying the material into surface cracks on the roadway, if a retarder is not added to the mix.

In order to overcome these difficulties, it has been discovered that the addition of a hardening agent to an anionic asphalt emulsion can be accomplished so that the resulting crackfiller material will be sufficiently quick-setting. It has been found that combining the hardening agent with the emulsion while in a supply tank is not satisfactory as the emulsion will harden too rapidly. The material solidifies or "freezes up" in the machinery before the tank is emptied. This also can result in a problem of cleaning out the tanks completely if mixing is discontinued for any period of time, such as when the tank or the applicator truck is parked overnight. For this reason, it is advantageous to add the hardening agent substantially concurrently with the application of the anionic emulsion to the roadway surface.

It has further been discovered that salt water is one inexpensive and readily available hardening agent or hardening accelerator for anionic asphalt emulsions. It is believed that the salt water acts to extract or facilitate rapid expulsion of the water of the emulsion so that the hydrocarbon compounds within the emulsion can coalesce and harden.

It has been found that a solution of water and salt on a volume ratio basis of between about 16:1 and 80:1 advantageously provide a concentration which will accelerate the hardening. Other concentrations may be useful to slow or increase the hardening process. Hardening will result within minutes or within a few hours depending on the thickness of the material applied.

Figure 1:
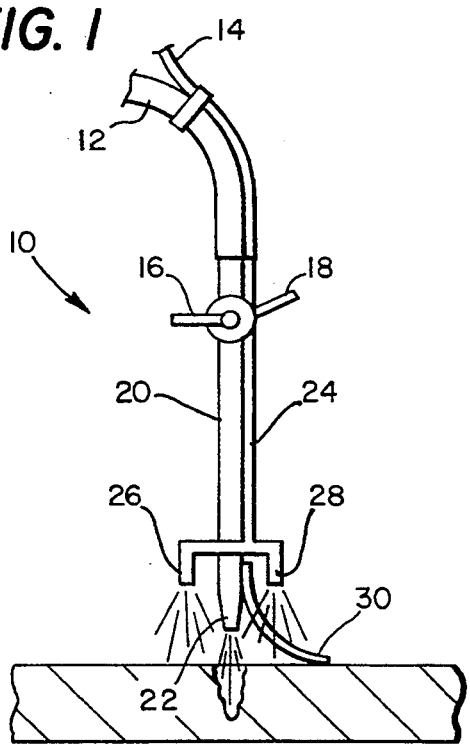
FIG. 1 is a side plan view of the cold emulsion crackfiller wand according to the present invention.

For purposes of applying this desirable low temperature, fast-setting crackfill material, an applicator wand has been invented as shown in one embodiment in FIG. 1. The crackfiller wand 10 is supplied with the emulsified anionic asphalt, latex, ground rubber emulsion, such as a supply hose 12. The wand also receives the hardening agent through a supply hose 14. Both hoses 12 and 14 will typically extend from a movable vehicle having a crackfiller supply tank and a hardening agent or salt water tank (not shown). The wand has, at a convenient location which is reachable by the user, a filler material valve 16 and a hardening agent valve 18. An emulsified material tube 20 extends downward from the valve to a spray nozzle 22 by which the user may direct the emulsified material into irregular crack shapes in the surface to be repaired. Also, there is a hardening agent tube 24 which leads to a first hardening agent spray nozzle 26. The nozzle 26 is preferably directed ahead of and partially into the spray of the emulsified filler nozzle 22. In this manner, a fine mist of hardening agent, such as a salt water spray is directed into the crack to be filled and is also added directly into the emulsion. This allows hardening throughout the volume of the crack from the bottom to the top. It has also been found to be advantageous to have a second hardening agent spray nozzle 28 which follows the applicator wand and provides a spray of the hardening agent over the top of the filled crack.

It has further been found to be advantageous to provide a resilient or flexible smoothing blade 30 on the end of the applicator wand. The smoothing blade 30 trails the wand and applies a downward and smoothing pressure on the top of the emulsion to make it level with the roadway surface. Where a rubber smoothing blade 30 is used, it is advantageous to have the second hardening agent or salt water spray nozzle 28 trailing the smoothing blade 30 so that the surface of the filler material left exposed by the blade will have the hardening agent applied directly to it. The use of the rubber smoothing blade advantageously eliminates the need for a manually operated squeegee device.

For immediate service of the traffic surface after repair, sand or other aggregate material can be spread on the cracks and forced down into the material while it is hardening to thereby increase the speed of the hardening and further facilitate rapid use of the roadway. As the crackfiller material according to the present invention will continue to have limited plastic characteristics for a period of time while complete curing is taking place, the application of sand need not be immediate but may be applied using mechanical pressure such as rolling or other such means to force the sand into the recently filled cracks. This step can often be eliminated as the solidification takes place very rapidly without the sand or aggregate.

Figure 2:
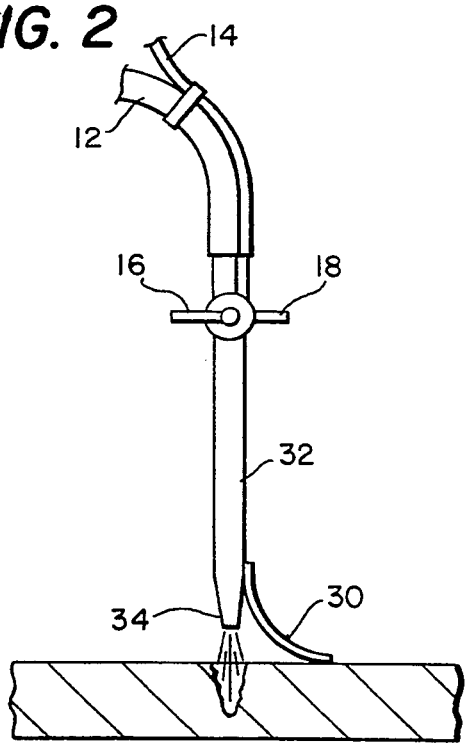
FIG. 2 is a side plan view of an alternative embodiment of the crackfiller wand in which the hardening agent is mixed with the emulsified asphalt in the wand prior to dispensing through the nozzle.
Figure 3:
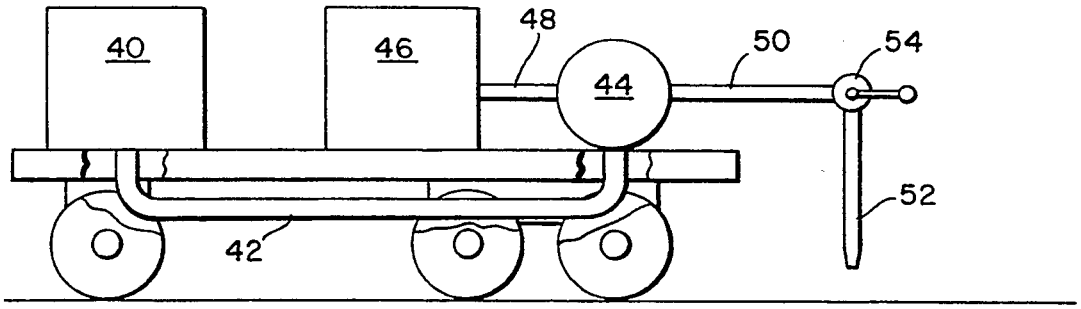
FIG. 3 is a schematic view of a mixing pump according to another embodiment of the invention.

In an alternative embodiment of the applicator wand as shown in FIG. 2, mixing of the emulsion and the salt water can take place within a mixing tube 32 immediately prior to application. The mixture of anionic asphalt emulsion and hardening accelerator is applied through an applicator nozzle 34. With reference again to both FIGS. 1 and 2, the emulsion valve 16 and the hardening agent valve 18 may be operated independently so that the mixture of emulsion to hardening agent can be adjusted by the user. Alternatively, mixing in appropriate proportions can be accomplished by having on/off valves 16 and 18 whereby the nozzle orifices combined with the supply pressure accurately meter the mixture of emulsion to hardening agent. The wand is properly adjusted simply by turning both of the valves to full on. In a further alternative embodiment, both valves 16 and 18 may be operated with a single lever such that the total quantity of emulsion and hardening agent can be varied while the proper proportions of each component of the mixture is maintained, With reference to FIG. 3, which is a schematic diagram of a crackfilling apparatus and method according to the present invention, the crackfiller emulsion material tank 40 supplies emulsion through conduit 42 directly to a mixing pump 44. Also the hardening agent or accelerator tank 46 supplies the mixing pump 44 through conduit 48 with accelerator agent. The emulsion and added hardening agent are mixed and pumped through conduit 50 to applicator wand 52 having a single actuation valve 54. In this manner, the material applied to the cracks can be completely mixed with the added hardening agent to provide a syrupy fluid substance which flows evenly into the cracks and results in thorough solidification throughout the crack.

Figure 4:
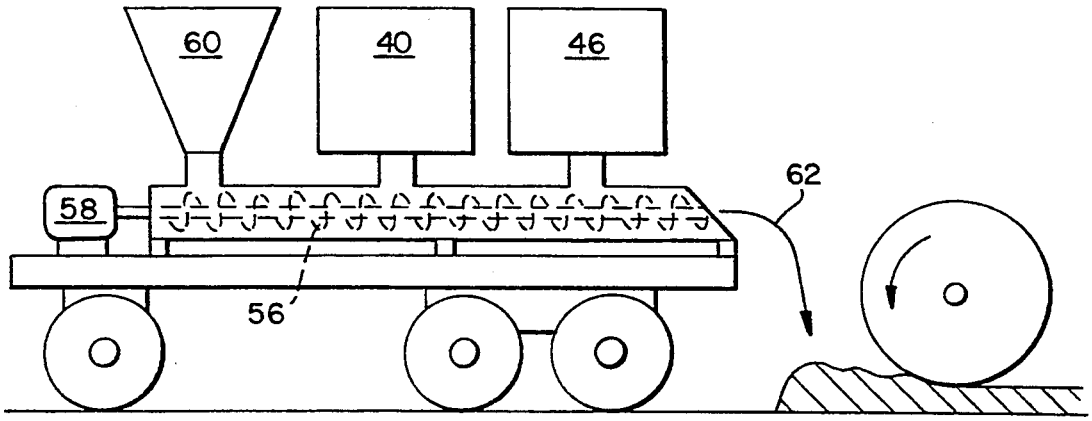
FIG. 4 is a schematic view of a road repair or paving system in which a hardening agent is applied to an anionic paving material.

With reference to FIG. 4, which a side schematic view of a machine according to the present invention for paving repairs or pothole filling in which the anionic emulsion tank 40 supplies emulsion to a conveyor or auger 56 which is driven by motor 58. Also, an aggregate hopper 60 supplies the emulsion in the auger with aggregate mixture. The two are conveyed onward to a point at which the hardening agent from hardening agent tank 46 is supplied to the auger and continued to mix until the aggregate is expelled at 62 for application to the roadway surface. The material is smoothed onto the roadway to form a paving surface or smoothed to fill a pothole as required. As the hardening agent is mixed throughout the aggregate and emulsion as by auger action, the hardening takes place throughout the mixture and allows the use of an anionic emulsions for paving and pothole patching. This can avoid the need to import an aggregate which can only be mixed with a cationic emulsion, thereby reducing the cost of paving or pothole patching without reducing the quality of road repair. Further, this advantageously permits the use of an anionic emulsion which can be stored for longer periods of time without freezing in the storage tank or the vehicle supply tank.

While the inventive material, applicator wand, and method of application have been described in connection with certain preferred embodiments, it is not intended to limit the scope of the invention to the particular forms set forth, but on the contrary, it is intended to cover such alternatives, modifications, and equivalents as may be included within the spirit and scope of the invention.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A method of filling cracks in a traffic-bearing surface comprising the steps of:

a) applying an anionic emulsion including water, asphalt, latex, and ground rubber into a crack to be filled;

b) adding a hardening agent with the anionic emulsion as it is being applied, wherein the step of adding a hardening agent comprises the step of mixing salt water with the anionic emulsion as it is being applied.

2. The method of filling cracks as in claim 1 wherein the step of applying an anionic emulsion into a crack to be filled comprises the step of directing a spray of the emulsion into the crack with an applicator wand and the step of mixing salt water with the anionic emulsion comprises the step of spraying a mist or a fog of salt water directly into the spray of the emulsion as it is being directed into the crack to be filled.

3. A method of filling cracks in a traffic-bearing surface comprising the steps of:

a) applying an anionic emulsion including water, asphalt, latex, and ground rubber into a crack to be filled.; and b) adding a hardening agent with the anionic emulsion as it is being applied, wherein the step of adding a hardening agent comprises the step of mixing salt water into the emulsion prior to applying the mixture to the traffic-bearing surface.

* * * * *